United States Patent [19]

Ito et al.

[11] Patent Number: 4,950,953

[45] Date of Patent: Aug. 21, 1990

[54] HIGH PRESSURE SODIUM LAMP WITH SODIUM AMALGAM OF CONTROLLED AMOUNT SEALED THEREIN

[75] Inventors: Akira Ito; Kazuyoshi Okamura; Kazuiki Uchida, all of Tokyo, Japan

[73] Assignee: Kabushiki Kaisha Toshiba, Kawasaki, Japan

[21] Appl. No.: 277,999

[22] Filed: Nov. 30, 1988

[30] Foreign Application Priority Data

Nov. 30, 1987 [JP] Japan ..... 62-299908

[51] Int. Cl.[5] ..... H01J 61/30; H01J 61/36; H01J 61/28; H01J 61/22

[52] U.S. Cl. ..... 313/564; 313/624; 313/625; 313/638

[58] Field of Search ..... 313/624, 625, 638, 564, 313/552; 445/26, 53, 54

[56] References Cited

U.S. PATENT DOCUMENTS

| | | | |
|---|---|---|---|
| 4,156,550 | 5/1979 | Furukubo et al. | 445/53 |
| 4,539,511 | 9/1985 | Denbigh et al. | 313/625 X |
| 4,560,903 | 12/1985 | Sneijers et al. | 313/625 |

FOREIGN PATENT DOCUMENTS

| | | |
|---|---|---|
| 57-145261 | 9/1982 | Japan . |
| 58-140963 | 8/1983 | Japan . |

OTHER PUBLICATIONS

IEEE Proc., Vol. 128, Pt. A, No. 6, Sep. 1981, J. A. J. M. van Vliet, Ir., and J. J. de Groot, Dr. Ir. "High-Pressure Sodium Discharge Lamps".

*Primary Examiner*—Palmer C. DeMeo

*Attorney, Agent, or Firm*—Oblon, Spivak, McClelland, Maier & Neustadt

[57] ABSTRACT

A high pressure sodium lamp including a light permeable arc tube and an electrode extending into the arc tube via a central aperture provided in the arc tube. The electrode is supported in the aperture by means of a glass solder sealing composition. Sodium amalgam is seated in the arc tube and condensed at a corner thereof. To prevent sodium amalgam condensed at the corner of the arc tube from contacting the glass solder filled in the central aperture of the arc tube, sodium amalgam including sodium of 10–30 (wt %) is sealed in the arc tube at a prescribed volume V ($mm^3$) which substantially satisfies the following relationship:

$$Vo/3 \leqq V \leqq Vo \quad \text{when } WL \text{ is less than 200, or}$$

$$Vo/4 \leqq V \leqq Vo \quad \text{when } WL \text{ is equal to or greater than 200,}$$

$$\text{when } Vo = \frac{\pi}{192}(5D^3 - 9D^2d + 3Dd^2 + d^3), \text{ and}$$

where D (mm) is the diameter of the arc tube, d (mm) is the diameter of the central aperture, Vo ($mm^3$) is the volume of the sodium amalgam sealed in the arc tube when the shortest distance between the sodium amalgam condensed at the corner and the glass solder filled in the central aperture is given by $$\frac{D-d}{4},$$

and WL (W) is the lamp power.

12 Claims, 5 Drawing Sheets

HIGH PRESSURE SODIUM LAMP WITH SODIUM AMALGAM OF CONTROLLED AMOUNT SEALED THEREIN

BACKGROUND OF THE INVENTION

1. Field of the Invention

The present invention relates in general to a high pressure sodium lamp having an arc tube and sodium amalgam sealed in the arc tube, and in particular to a relationship between the arc tube structure and the amount of sodium amalgam sealed in the arc tube.

2. Description of the Background

In general, high pressure sodium lamps typically include a ceramic arc tube in which an amount of xenon gas and a sodium amalgam are sealed. The sodium in the sodium amalgam sealed in the arc tube gradually reacts with ceramic of the arc tube, and thus, some amount of sodium is lost during an operational life period of the lamp. To compensate for the amount of the lost sodium, an excess amount of sodium amalgam is sealed in the arc tube in advance. It is conventionally believed that the greater the amount of sodium amalgam sealed in the arc tube, the better.

FIG. 1 shows one example of a conventional high pressure sodium lamp. A soldered alumina plug 11 includes a central aperture 13 through which a thin-walled niobium tube 15 penetrates at a short distance. Niobium tube 15 is hermetically sealed through central aperture 13 by a sealing composition, e.g., glass solder, indicated by a thick line at 17. Niobium tube 15 acts as an exhaust tube and as an inlead. Plug 11 has its neck portion extending into an alumina arc tube 19, and the edge portion of tube 19 butts against the solder portion of plug 11. The contact portion between arc tube 19 and plug 11 is hermetically sealed by a sealing composition, e.g., glass solder, indicated at 21 and 23. A coiled electrode 25 is fixed on the top portion of niobium tube 15 located in arc tube 19. The inside of niobium tube 15 is in fluid communication with the inside of arc tube 19 through an aperture 27 formed at the side wall of niobium tube 15. The outer end portion 29 of niobium tube 15 is squeezed after exhausting air in arc tube 19 and niobium tube 15. At this time, an excess sodium amalgam 30 is provided in arc tube 19 and niobium tube 15. The sodium amalgam is accumulated at the inside of outer end portion 29 because it is at a low temperature.

In the above-described high pressure sodium lamp, since the outer end portion 29 of niobium tube 15 outwardly extends from arc tube 19, the temperature of the outer end portion 29 hardly rises. Furthermore, since undesirable trenches or unevenness occur in the inner surface of niobium tube 15 during the forming process, liquidized sodium amalgam tends to move into arc tube 19 along such trenches by a capillary action, and therefore, the lamp characteristics of the sodium lamp are adversely affected.

FIG. 2 shows another example of a conventional high pressure sodium lamp. In this case, a high pressure sodium lamp includes a monolithic tube 31 composed of an alumina arc tube portion 33 and an alumina plug portion 35 integrally formed with the arc tube portion 33. Alumina plug portion 35 of monolithic tube 31 has a central aperture 37 through which a niobium tube 39 penetrates at a short distance. Niobium tube 39 and alumina plug portion 35 are hermetically sealed by a sealing composition, e.g., glass solder, indicated by a thick line at 41. An electrode 43 is fixed on the penetrating end portion of niobium tube 39.

In the high pressure sodium lamp shown in FIG. 2, since no aperture permitting fluid communication between the inside of niobium tube 39 and the inside of arc tube 31 is provided in the surface of niobium tube 39, sodium amalgam 45 is liquidized and stays in a ring-shaped state along an inner end corner 45 of monolithic tube 31, the temperature of which is lower than that of remaining portions thereof. In this case, since the low temperature portion is part of monolithic tube 31, the temperature thereof rises easily. Furthermore, since alumina monolithic tube 31 seldom has trenches or unevenness at the inner surface thereof, undesirable movement of sodium amalgam does not occur. Characteristics of the lamp are rarely changed.

However, in this type of lamp shown in FIG. 2, the end portion of monolithic tube 31 was intensely blackened after 3,000 hours elapsed in an operational life period when the diameter of monolithic tube 31 was reduced or the amount of sodium amalgam sealed in monolithic tube 31 was increased. Thus, the lamp voltage of the lamps having monolithic tube 31 greatly increased, and some of the lamps resulted in cycling. This is because, as determined according to the present invention, a part of sodium amalgam 45 is in contact with glass solder 41, and thereby, sodium of sodium amalgam 45 reacts to a component of glass solder 41.

Japan Laid-open patent application (KOKAI) 58-140963 discloses a high pressure sodium lamp assembly shown in FIG. 3. A monolithic arc tube 51 made of ceramic includes a hollow body portion 53 and a plug portion 55 having a central aperture 57. A ring-shaped inner wall 59 extends from the edge of central aperture 57 toward the inside of arc tube 61. A niobium tube 61 penetrates through central aperture 57, and is hermetically sealed by a sealing composition 62, e.g., glass solder. An electrode 63 is fixed on the top portion of niobium tube 61. In the above-described sodium lamp, ring-shaped inner wall 59 prevents sodium amalgam from being in contact with electrode 63. Ring-shaped inner wall 59 also prevents sodium amalgam from being in contact with sealing composition 62. However, since the constitution of plug portion 55 having ring-shaped inner wall 59 is complicated, it is technically difficult to mass produce such a monolithic tube.

SUMMARY OF THE INVENTION

It is an object of the present invention to provide a new and improved high pressure sodium lamp in which the volume of sodium amalgam sealed in the arc tube is controlled to prevent the sodium amalgam from contacting the glass solder acting as a sealing material in the high pressure sodium lamp.

To accomplish the above-described object, the high pressure sodium lamp of the present invention includes a light permeable arc tube having opposite ends, a pair of plug portions each airtightly disposed at corresponding opposite ends of the arc tube, and a pair of electrodes oppositely supported by the corresponding plug portion pairs. The plug portion pairs each include a central aperture through which a respective electrode extends into the arc tube. The electrode is fixed by a sealing composition filled in the central aperture. The lamp also includes sodium amalgam sealed in the arc tube and having a prescribed volume which is controlled to prevent the sodium amalgam condensed at a corner defined by one of the ends of the arc tube and the one of the plug pairs from contacting the sealing composition filled in the central aperture of the plug.

According to another aspect of the present invention, a high pressure sodium lamp includes a light permeable arc tube of a prescribed diameter D (mm) having opposite plug portions, a pair of electrode elements, each extending into the arc tube through a central aperture of a predetermined diameter d (mm) formed in a respective opposite plug portion and being fixed by a glass solder filled in the central aperture, and sodium amalgam including sodium of 10–30 (wt %) sealed in the arc tube at a prescribed volume (V) which substantially satisfies the following relationship for preventing sodium amalgam condensed at the corner defined by the one of the plug portions and the arc tube from reacting on the glass solder:

$$Vo/3 \leqq V \leqq Vo \quad \text{when } WL \text{ is less than 200, or}$$

$$Vo/4 \leqq V \leqq Vo \quad \text{when } WL \text{ is equal to or greater than 200,}$$

$$\text{when } Vo = \frac{\pi}{192}(5D^3 - 9D^2d + 3Dd^2 + d^3), \text{ and}$$

where Vo ($mm^3$) is the volume of the sodium amalgam sealed in the arc tube when the shortest distance between the sodium amalgam condensed at the corner portion of the arc tube and the sealing composition filled in the central aperture is indicated by the expression $$\frac{D-d}{4},$$

and WL (W) is the lamp power.

According to still another aspect of the present invention, a high pressure sodium lamp includes a light permeable arc tube, and a pair of plug portions airtightly disposed at opposite ends of the arc tube. One of the plug portion pairs includes a central depression of a prescribed diameter D (mm) exposed to the inside of the arc tube, and a central aperture of a predetermined diameter d (mm) formed in the depression. The lamp includes an electrode element which extends into the arc tube through the central aperture and is fixed by the glass solder filled in the central aperture. The lamp also includes sodium amalgam sealed in the arc tube at a prescribed volume (V) which substantially satisfies the following relationship for preventing the sodium amalgam condensed at the corner of the depression from contacting the glass solder:

$$Vo/3 \leqq V \leqq Vo \quad \text{when } WL \text{ is less than 200, or}$$

$$Vo/4 \leqq V \leqq Vo \quad \text{when } WL \text{ is equal to or greater than 200,}$$

$$\text{when } Vo = \frac{\pi}{192}(5D^3 - 9D^2d + 3Dd^2 + d^3), \text{ and}$$

where Vo ($mm^3$) is the volume of the sodium amalgam sealed in the arc tube when the shortest distance between the sodium amalgam condensed at the corner portion of the arc tube and the sealing composition filled in the central aperture is indicated by the expression $$\frac{D-d}{4},$$

and WL (W) is the lamp power.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
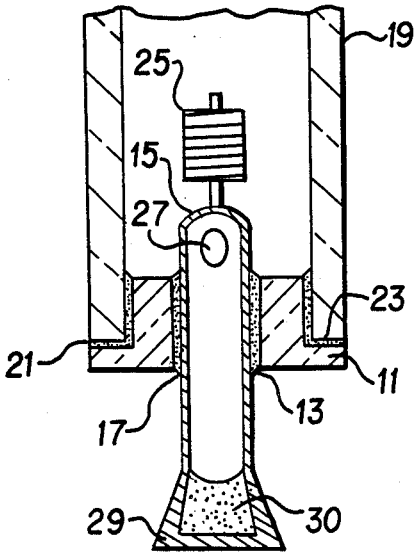
FIG. 1 PRIOR ART
FIG. 1 is a fragmentary cross-sectional view illustrating a first example of the high pressure sodium lamp.
Figure 2:
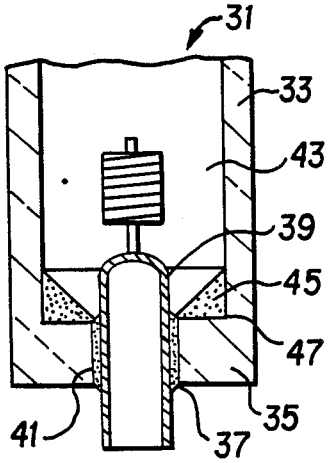
FIG. 2 PRIOR ART
FIG. 2 is a fragmentary cross-sectional view illustrating a second example of a prior art high pressure sodium lamp.
Figure 3:
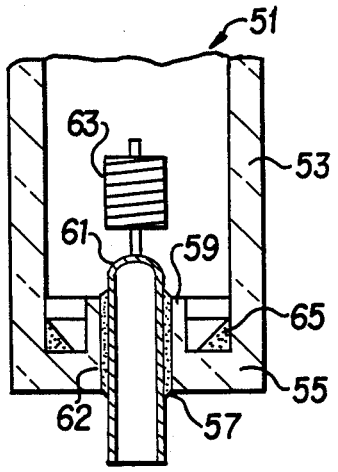
FIG. 3 PRIOR ART
FIG. 3 is a fragmentary cross-sectional view illustrating a third example of a prior art high pressure sodium lamp.
Figure 5:
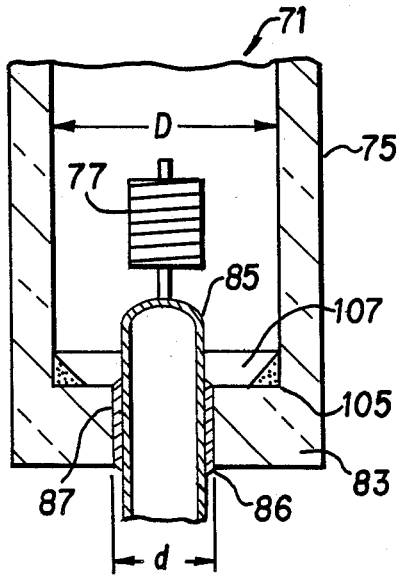
FIG. 5 is a fragmentary cross-sectional view illustrating the relationship between glass solder filled in the central aperture of a plug and sodium amalgam condensed around the corner of an arc tube of the high pressure sodium lamp shown in FIG. 4.
Figure 4:
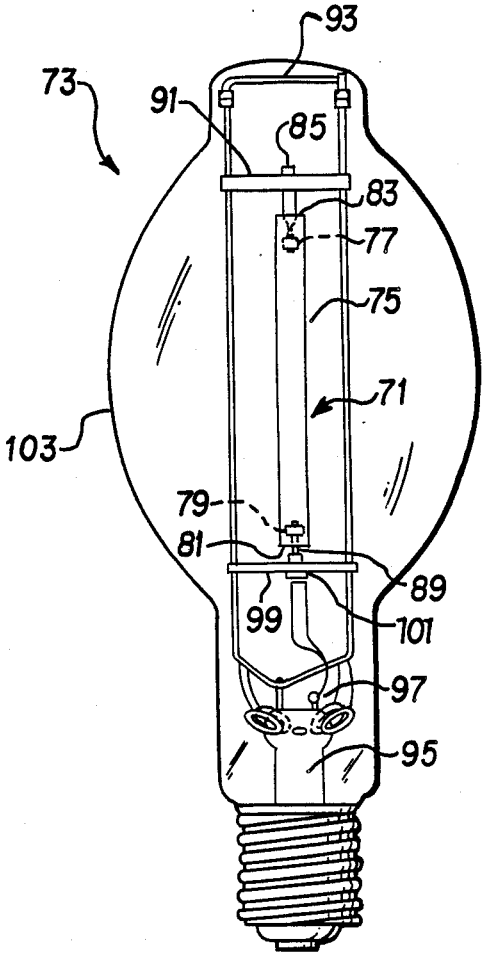
FIG. 4 is a side view illustrating a high pressure sodium lamp of one embodiment of the present invention.

Referring now to the drawings, wherein like reference numerals designate identical or corresponding parts throughout the several views, in FIG. 4, an arc tube 71 of the high pressure sodium lamp 73 of the present invention includes a bulb 75 and a pair of electrodes 77 and 79 individually disposed at opposite ends of bulb 75. Bulb 75 has a translucent ceramic envelope, such as, e.g., alumina ceramic, containing a fill of a proper amount of starting rare gas, such as, xenon, mercury or sodium. To seal the opposite ends of bulb 75 airtightly, a pair of plugs 81 and 83 made of alumina ceramic are individually fixed to each end of bulb 75. In this case, arc tube 71 is a monoithic arc tube, and therefore, the pair of plugs 81 and 83 is integrally formed with bulb 75. Such a monolithic tube is made of alumina granules. Alumina granules with a binder are formed into a tube-shape by a press forming, and are also formed into a disk-shape. The tube-shaped bulb and the disk-shaped plug are individually sintered at 1,000° C. for 30 minutes to eliminate the binder therefrom. The disk-shaped plug is disposed at the open end portion of the tube-shaped bulb after reforming the bulb and the plug to a prescribed size. The assembled structure of the bulb and the plug is further sintered at 1,800° C. for 2 or 3 hours in a hydrogen atmosphere. A metal tube 85 made of niobium penetrates through a central aperture 86 of plug 83 at a short distance and is fixed by glass solder 87 to the plug, as shown in FIG. 5. The penetrating end of tube 85 is closed, and one of the electrodes 77 is welded thereto. The other electrode 79 disposed in bulb 75 is fixed to a lead wire 89 made of niobium. Lead wire 89 penetrates plug 81 and is fixed to plug 81 with the glass solder in an airtight state.

During the manufacture of arc tube 71, a fill of starting rare gas, such as, xenon, mercury or sodium is sealed in arc tube 71. Mercury and sodium (sodium amalgam) are supplied in excess to arc tube 71, as compared with the vapored amount thereof needed for proper operation. The outer end of metal tube 85 is supported by a metal plate 91 firmly fixed to a supporting rod 93. Supporting rod 93 is supported by a stem 95 so that a voltage can be applied to electrode 77 through supporting rod 93, metal plate 91 and metal tube 85. One end of the lead wire 89 is connected to electrode 79, as described above, and the other end thereof is connected to a lead 97 supported by stem 95. A voltage may be applied to electrode 79 through lead 97 and lead wire 89. A metal plate 99 is welded to support rod 93. An insulating bushing 101 is fixed at the center of metal plate 99. Lead wire 89 penetrates insulating bushing 101, and is supported by metal plate 99 through insulating bushing 101. More specifically, lead wire 89 loosely penetrates insulating bushing 101 so that lead wire 89 may have some, but not an excessive amount of movement in the axial direction thereof. As a consequence, when arc tube 71 expands in the axial direction thereof during the operation, lead wire 89 moves along insulating bushing 101 to absorb the expansion of tube 71.

Arc tube 71 supported by supporting rod 93 is held in an outer envelope 103 made of hard glass. In this case, the inner diameter (D) of arc tube 71 is set at 4.5 mm, and the diameter (d) of central aperture 86 of plug 83 is set at 2.06 mm. The sodium amalgam includes 10–30 (wt %) of sodium, which is generally used in this type of the lamp. An amount (volume V) of sodium amalgam sealed in arc tube 71 is 2.39 $mm^3$.

In the above-described embodiment, the temperature of the corner portion 105 defined by bulb 75 and plug 83 is maintained lower than that of other portions of arc tube 71 during operation. This is because heat from electrode 77 is conducted to supporting rod 93 through metal tube 85 and metal plate 91. Therefore, sodium amalgam 107 sealed in arc tube 71 is condensed in a ring-shape at corner portion 105 of arc tube 71 while the lamp is operated, as shown in FIG. 5. Since the viscosity of sodium amalgam is relatively large, a longitudinal section of the condensed sodium amalgam 107 is substantially triangle-shaped.

With the arrangement described above, no glass solder is disposed at the corner 105 of arc tube 71 where the sodium amalgam is condensed because of the monolithic structure of arc tube 71. Furthermore, since the amount of sodium amalgam sealed in arc tube 71 is controlled at a prescribed value, sodium amalgam does not contact glass solder disposed around central aperture 86 of plug 83. Blackening of the end portion of arc tube 71 and extinction of arc tube 71 caused by the reaction between sodium amalgam and glass solder can thus be avoided.

An operational life experiment was carried out with the above described high pressure sodium lamp under the condition wherein the supply voltage was 200 V, and the operation cycle was 5.5 hours ON and 0.5 hours OFF. Five sample groups each consisting of twenty lamps were made by varying the amount of sodium amalgam, including sodium of 10 wt %, sealed in the arc tube. The other five sample groups each consisting of twenty lamps were also made by varying the amount of sodium amalgam including sodium of 15 wt %. The lamp voltage (VL) of each lamp of each sample group was measured after 100 hours of operation, 3,000 hours of operation and 9,000 hours of operation. The measured lamp voltage values of each lamp in each sample group were averaged over each measuring time. The average increasing value of lamp voltage (VL) of each sample group between 100 hour operation and 3,000 hour operation was determined. The other average increasing value of lamp voltage (VL) of each sample group between 100 hour operation and 9,000 hour operation also was determined. Table 1 shows the result of the experiment described above.

TABLE 1

| SODIUM AMALGAM | | AVERAGE INCREASING VALUE OF LAMP VOLTAGE (V) | |
|---|---|---|---|
| SODIUM (wt %) | SEALED AMOUNT INTO ARC TUBE (mg) | BETWEEN 100(h) & 3,000(h) | BETWEEN 100(h) & 9,000(h) |
| 10 | 42 | 10 | 22 (Extinction: 11 Samples) |
| | 29 | 7 | 15 (Extinction: 6 Samples) |
| | 14.6 | 5 | 8 |
| | 7.3 | 4 | 5 |
| | 4.8 | 2 | −3 |
| 15 | 33 | 9 | 20 (Extinction: 10 Samples) |
| | 22 | 7 | 14 (Extinction: 4 Samples) |
| | 11.2 | 3 | 7 |
| | 5.6 | 4 | 5 |
| | 3.7 | 2 | −4 |

As can be understood from TABLE 1, the increase in lamp voltage is small and extinction is not observed even after 9,000 hour operation when the sealed amount of sodium amalgam including sodium of 10 wt % is less than 14.6 mg or the sealed amount of sodium amalgam including sodium of 15 wt % is less than 11.2 mg. A small increase in lamp voltage indicates that the high pressure sodium lamp maintains a high lumen maintenance factor, and therefore, has desirable operational life characteristics.

When the volume (V) of amalgam is determined with regard to 14.6 mg of sodium amalgam including sodium of 10 wt % and 11.2 mg of sodium amalgam including sodium of 15 wt %, it is found that in each instance the volume (V) of amalgam is equal to one another, that is, substantially 2.4 $mm^3$.

During the operation of arc tube 71, electrode 77 is maintained at a high temperature. However, since a part of the heat generated by electrode 77 is discharged through metal tube 85 by heat conduction, or is discharged through bulb 75 by heat radiation, the corner portion 105 defined by bulb 75 and plug 83 is maintained at a low temperature. Therefore, sodium amalgam sealed in arc tube 71 is condensed at the above-described corner portion 105 of arc tube 71 in a ring-shape, as described above. The cross section of sodium amalgam condensed is substantially triangle-shaped, as shown in FIG. 5. The shortest distance between the sodium amalgam condensed at the corner portion 105 and glass solder 87 disposed around central aperture 86 of plug 83 is half of the distance between corner portion 105 and central aperture 86 when the volume (V) of sodium amalgam sealed in arc tube 71 is 2.4 $mm^3$. This shortest distance is expressed as follows:

$$\left(\frac{D}{2} - \frac{d}{2}\right) \times \frac{1}{2} = \frac{D-d}{4} \quad (1)$$

wherein D (mm) is an inner diameter of arc tube 71, and d (mm) is a diameter of central aperture 86.

Figure 6:
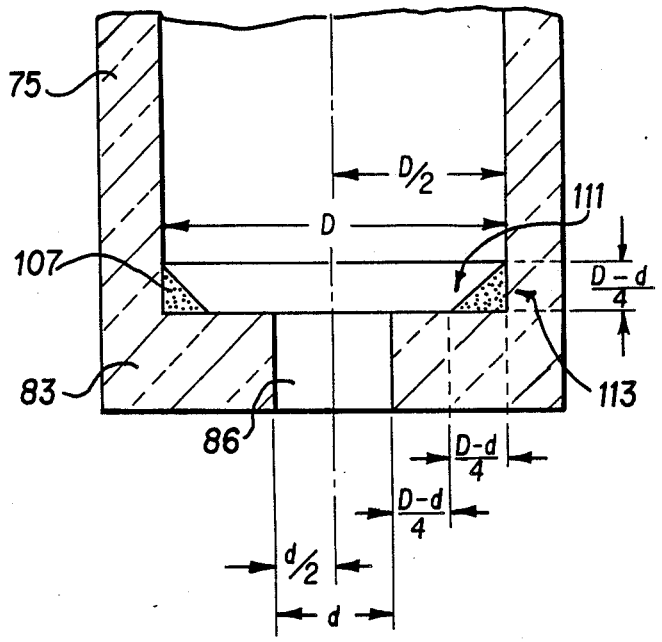
FIG. 6 is a fragmentary cross-sectional view of the lamp of FIG. 4 illustrating the arc tube and condensed sodium amalgam with no electrode and metal tube.

Referring to FIG. 6, a method for calculating the volume (Vo) of sodium amalgam sealed in arc tube 71 is next described when the shortest distance between sodium amalgam 107 condensed at corner portion 105 of arc tube 71, and having the triangle-shaped cross section, and the glass solder, i.e., the edge of central aperture 86, satisfies the above-described expression (1). The volume (Vo) of sodium amalgam is determined by subtracting a volume (Va) of the frustrum of a cone 111 from a volume (Vb) of a cylinder 113.

The volume (Vb) of cylinder 113 substantially satisfies the following equation (2):

$$Vb = \pi \frac{D^2}{2} \times \frac{D-d}{4} = \frac{\pi}{16}(D^3 - D^2 d) \quad (2)$$

The volume (Va) of the frustrum of cone 111 substantially satisfies the following equation (3):

$$\begin{aligned} Va &= \frac{1}{3}\pi(R^2 + Rr + r^2) \times h \\ &= \frac{\pi}{192}(7D^3 - 7D - 4D^2 d + 5Dd^2 - d^3) \end{aligned} \quad (3)$$

wherein R is a diameter of one of the base areas of the frustrum of cone 111, and r is the diameter of the other base area of the frustrum of cone 111.

$$\begin{aligned} Vo &= Vb - Va \\ &= \frac{\pi}{192}(5D^3 - 9D^2 d + 3Dd^2 + d^3) \end{aligned} \quad (4)$$

As can be understood from the above-described equation (4), the shortest distance between sodium amalgam 107 condensed at corner portion 105 of arc tube 71 and the glass solder 87 (edge of central aperture 86) is maintained at a distance expressed by the above-described equation (1) when the volume of sodium amalgam sealed in arc tube 71 is Vo ($mm^3$).

An operational life experiment wherein an operational state of the lamp was observed after 12,000 hours total elapsed operational period was carried out by varying the inner diameter D of arc tube 71 and the diameter r of central aperture 86 of plug 83 when the volume of sodium amalgam sealed in arc tube 71 was Vo ($mm^3$). TABLE 2 shows each of the specifications of samples used in the above-described operational life experiment.

TABLE 2

| | | | SODIUM - AMALGAM | | | |
|---|---|---|---|---|---|---|
| LAMP-INPUT (W) | D (mm) | d (mm) | SODIUM (wt %) | SPECIFIC GRAVITY | SEALED AMOUNT INTO ARC TUBE (mg) | vo ($mm^3$) |
| 70 | 4.5 | 2.06 | 10 | 6.1 | 14.6 | 2.39 |
| " | " | " | 15 | 4.7 | 11.2 | " |
| 150 | 5.5 | 3.06 | 10 | 6.1 | 18.1 | 2.97 |
| " | " | " | 15 | 4.7 | 14.0 | " |
| 250 | 7.25 | 3.06 | 15 | 4.7 | 53.0 | 11.28 |
| " | " | " | 20 | 3.8 | 42.9 | " |
| 400 | 8.0 | 3.06 | 15 | 4.7 | 69.1 | 14.71 |
| " | " | " | 20 | 3.8 | 55.8 | " |
| 700 | 9.5 | 3.06 | 20 | 3.8 | 123.3 | 32.45 |
| " | " | " | 25 | 3.2 | 103.8 | " |
| 1000 | 11 | 3.76 | 25 | 3.2 | 161 | 50.37 |
| " | " | " | 30 | 2.78 | 140 | " |

In the above-described experiment, an increase in lamp voltage above 20 V was not observed during the operational life period. Also, no extinction of a lamp was observed. This is because the distance between the condensed sodium amalgam and glass solder is maintained at a suitable range, and therefore, reaction between the condensed sodium amalgam and glass solder can be avoided. As can be understood from the above-described consideration, a desirable result is obtained when the volume of the sodium amalgam sealed in the arc tube is less than Vo ($mm^3$) in each lamp listed in TABLE 2.

With regard to the lower limit of the amount of sodium amalgam sealed in the arc tube, a decrease in lamp voltage is caused by a shortage of sodium, and therefore, an excess heat of a ballast may occur during operation if the amount of sodium amalgam sealed in the arc tube is excessively small. A desirable lower limit of the sealed amount of sodium amalgam which causes the average increasing value of lamp voltage to be maintained under 20 V when a rated operational life period, i.e., 12,000 hours, has elapsed is as follows:

Vo/3 . . . when a lamp power (WL) is less than 200 (W), or

Vo/4 . . . when a lamp power (WL) is equal to or greater than 200 (W).

As can be understood from the above description, a desirable range of sealed amount (volume V) of sodium amalgam including sodium of 10–30 wt % should satisfy the following relationship:

$Vo/3 \leqq V \leqq Vo$ . . . when a lamp power (WL) is less than 200 (W), or $Vo/4 \leqq V \leqq Vo$ . . . when a lamp power (WL) is equal to or greater than 200 (W).

Figure 7:
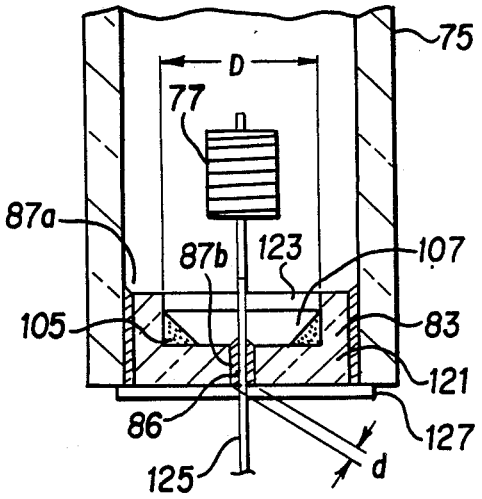
FIG. 7 is a fragmentary cross-sectional view illustrating the relationship between glass solder filled in the central aperture of a plug and sodium amalgam condensed around the corner of a depressed portion of the plug in a second embodiment of the present invention.
Figure 8:
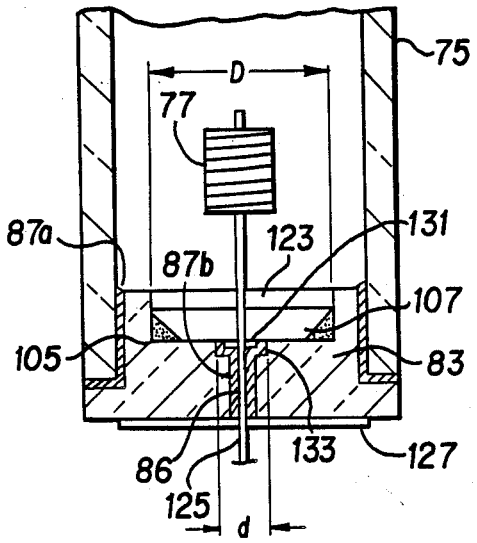
FIG. 8 is a fragmentary cross-sectional view illustrating the relationship between glass solder filled in the central aperture of a plug including a step portion and sodium amalgam condensed around the corner of a depressed portion of the plug in a third embodiment of the present invention.

Second and third embodiments of the present invention will be described hereafter by referring to FIGS. 7 and 8. In FIGS. 7 and 8, parts having similar construction as the corresponding parts of the above-described embodiment are designated by same reference numerals, and therefore, the detailed descriptions thereof are not repeated. The second and the third embodiments use an arc tube including a bulb portion having opposite open ends, and a pair of ceramic plugs each fixed to the opposite open ends of the bulb portion by a sealing composition, instead of a monolithic tube used in the first embodiment.

The second embodiment of the present invention is shown in FIG. 7. An alumina ceramic plug 121 is provided with a depression 123 at a center thereof. Plug 121 is positioned at the open end of an alumina ceramic bulb 75 such that depression 123 of plug 121 is exposed to the inside bulb 75. The outer wall of plug 121 is airtightly fixed to the inner wall of bulb 75 by a glass solder 87*a*. Electrode 77 is supported by a niobium leadin wire 125 extending into bulb 75 through a central aperture 86 of plug 121. Niobium wire 125 is airtightly fixed to the central aperture 86 through glass solder 87*b*. A steel wire 127 welded to niobium leadin wire 125 extends to the edge of bulb 75 across plug 121 to support electrode 77 during manufacturing.

In this case, sodium amalgam sealed in excess in the arc tube 71 is condensed at the corner portion 105 of the inner surface of depression 123. Therefore, the inner diameter D of depression 123 is used as symbol D in equation (4), instead of the inner diameter of arc tube 71. A similar result to that of the first embodiment may be achieved in the second embodiment when the volume (V) of sodium amalgam sealed in the arc tube 71 is set at less than the volume (Vo) calculated by equation (4). Thus, a reaction between sodium amalgam 107 condensed at corner portion 105 of depression 123 and glass solder 87*b* filled in central aperture 86 of plug 121 may be avoided. Furthermore, since the glass solder 87*a* exists at the outer wall of plug 121, sodium amalgam condensed in depression 123 of plug 121 does not contact glass solder 87*a*.

The third embodiment of the present invention is next described. In FIG. 8, a flange 131 is welded to niobium leadin wire 125. Flange 131 acts as a stopper to prevent electrode 77 from excessive movement due to gravity during manufacturing. To fix flange 131 to central aperture 86 of plug 83, a step portion 133 is formed around central aperture 86. Central aperture 86 including step portion 133 is filled with glass solder 86 during manufacturing. In this embodiment also, a result similar to that of the first embodiment may be achieved in the above-described third embodiment when the volume (V) of sodium amalgam sealed in arc tube 71 is set at less than the volume Vo calculated by equation (4). However, in this case, the diameter d of step portion 133 shown in FIG. 8 is used as symbol D in equation (4), instead of the diameter of the central aperture 86.

In summary, the present invention overcomes the disadvantages of the prior art and provides an improved high pressure sodium lamp which may avoid a reaction between the glass solder used for fixing the electrode supporting element to the plug and the sodium amalgam condensed at the low temperature portion of the arc tube by controlling the volume of the sodium amalgam sealed in the arc tube at a prescribed range.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high pressure sodium lamp comprising:

a light permeable arc tube including opposite closed ends for defining a corner portion, the arc tube having a diameter D (mm), one of the closed ends including a substantially flat surface in which a central aperture of diameter d(mm) is formed;

electrode means extending into the arc tube through the central aperture for generating an arc;

a sealing composition filled in the central aperture for supporting said electrode means; and sodium amalgam sealed in the arc tube and being condensed at the corner portion during operation of the lamp, said sodium amalgam provided in an amount so that the condensed sodium amalgam does not contact the sealing composition during operation of the lamp, wherein said sodium amalgam comprises sodium of 10–30 (wt %) and has a prescribed volume V ($mm^3$) substantially satisfying the following relationship, $Vo/3 \leqq V \leqq Vo$ when $WL$ is less than 200, or $Vo/4 \leqq V \leqq Vo$ when $WL$ is equal to or greater than 200, where $Vo = \frac{\pi}{192}(5D^3 - 9D^2d + 3Dd^2 + d^3)$, and where Vo ($mm^3$) is the volume of the sodium amalgam sealed in the arc tube when the shortest distance between the sodium amalgam condensed at the corner portion of the arc tube and the sealing composition filled in the central aperture is given $$\frac{D-d}{4},$$

and WL (W) is the lamp power.

2. A lamp according to claim 1, wherein the sealing composition includes a glass solder.

3. A lamp according to claim 2, wherein the electrode means comprises:

a niobium tube having a closed top portion positioned inside the arc tube; and a coiled electrode supported by the closed top portion, the niobium tube being fixed at the central aperture by the glass solder filled in the central aperture.

4. A lamp according to claim 2, wherein the electrode means comprises:

a niobium wire extending through the central aperture; and a coiled electrode supported by the niobium wire, the niobium wire being fixed at the central aperture by the glass solder filled in the central aperture.

5. A high pressure sodium lamp comprising:

a light permeable arc tube having opposite ends; a pair of plugs disposed at corresponding opposite ends of the arc tube, one of the plug pairs having a central depression of a diameter D (mm), the central depression having a corner portion exposed to inside the arc tube and a substantially flat surface in which a central aperture of diameter d (mm) is formed:

electrode means extending into the arc tube through the central aperture of the one of the plug pairs for generating arc;

a sealing composition filled in the central aperture for supporting said electrode means; and a sodium amalgam sealed in the arc tube and being condensed at the corner portion of the depression of the plug during operation of the lamp, said sodium amalgam provided in an amount so that the condensed sodium amalgam does not contact the sealing composition during operation of the lamp, wherein said sodium amalgam comprises sodium of 10–30 (wt %) and has a prescribed volume V ($mm^3$) substantially satisfying the following relationship, $$Vo/3 \leqq V \leqq Vo \text{ when } WL \text{ is less than 200, or}$$

$$Vo/4 \leqq V \leqq Vo \text{ when } WL \text{ is equal to or greater than 200,}$$

$$\text{where } Vo = \frac{\pi}{192}(4D^3 - 9D^2d + 3Dd^2 + d^3), \text{ and}$$

where Vo ($mm^3$) is the volume of the sodium amalgam sealed in the arc tube when the shortest distance between the sodium amalgam condensed at the corner portion of the depression and the sealing composition filled in the central aperture is given by $$\frac{D-d}{4},$$

and WL (W) is the lamp power.

6. A lamp according to claim 5, wherein the sealing composition includes a glass solder.

7. A lamp according to claim 6, wherein the electrode means comprises:

a niobium wire extending through the central aperture of the plug; and a coiled electrode supported by the niobium wire, the niobium wire being fixed to the central aperture by the glass solder filled in the central aperture.

8. A high pressure sodium lamp comprising:

a light permeable arc tube having opposite ends;

a pair of plugs disposed at corresponding opposite ends of the arc tube, one of the plug pairs having a central depression of a diameter D (mm), the central depression having a corner portion exposed to the inside of the arc tube and a substantially flat surface in which a central aperture is formed, the flat surface being provided with a step portion of a diameter d (mm) around the central aperture;

electrode means extending into the arc tube through the central aperture of the plug for generating an arc;

a sealing composition filled in the central aperture and the step portion for supporting said electrode means; and a sodium amalgam sealed in the arc tube and being condensed at the corner portion of the depression of the plug during operation of the lamp, said sodium amalgam provided in an amount so that the condensed sodium amalgam does not contact the sealing composition during operation of the lamp.

9. A lamp according to claim 8, wherein the sodium amalgam comprises sodium of 10–30 (wt %) and has a prescribed volume V ($mm^3$) substantially satisfying the following relationship:

$$Vo/3 \leqq V \leqq Vo \text{ when } WL \text{ is less than 200, or}$$

$$Vo/4 \leqq V \leqq Vo \text{ when } WL \text{ is equal to or greater than 200,}$$

$$\text{where } Vo = \frac{\pi}{192}(5D^3 - 9D^2d + 3Dd^2 + d^3), \text{ and}$$

where Vo ($mm^3$) is the volume of the sodium amalgam sealed in the arc tube when the shortest distance between the sodium amalgam condensed at the corner portion of the depression and the sealing composition filled in the step portion and the central aperture of the flat surface is given by $$\frac{D-d}{4},$$

and WL (W) is the lamp power.

10. A lamp according to claim 9, wherein the sealing composition includes a glass solder.

11. A lamp according to claim 10, wherein the electrode means comprises:

a niobium wire extending through the central aperture of the plug; and a coiled electrode supported by the niobium wire, the niobium wire being fixed to the central aperture by the glass solder filled in the central aperture and the step portion.

12. A lamp according to claim 10, wherein the electrode means comprises:

a niobium wire extending through the central aperture of the plug;

a coiled electrode supported by the niobium wire, and a flange fixed to the niobium wire disposed in the step portion of the plug, the niobium wire and the flange being fixed to the central aperture by the glass solder filled in the central aperture and the step portion.

* * * * *